United States Patent [19]

Klein

[11] Patent Number: 5,014,321

[45] Date of Patent: May 7, 1991

[54] WIDE PASSBAND OMNIDIRECTIONAL LOUDSPEAKER

[75] Inventor: Siegfried Klein, Paris, France

[73] Assignee: Commissariat a l'Energie Atomique, Paris, France

[21] Appl. No.: 417,251

[22] Filed: Oct. 5, 1989

[30] Foreign Application Priority Data

Oct. 11, 1988 [FR] France ..... 88 13357
Oct. 11, 1988 [FR] France ..... 88 13358

[51] Int. Cl.[5] ..... H04R 3/00

[52] U.S. Cl. ..... 381/111; 381/190; 381/202

[58] Field of Search ..... 381/200, 202, 190, 111

[56] References Cited

U.S. PATENT DOCUMENTS 4,742,499 5/1988 Butler .

OTHER PUBLICATIONS

GB-A-1 124 127 (Gunnar Magnus Bergstrand).
EP-A-0 177 383 (Commissariate A L'Energie Atomique) Revendications Figures.
EP-A-0 075 911 (S. Klein) Revendications; Fig. 3; p. 8, ligne 20-p. 10. ligne 6.
EP-A-0 063 094 (S. Klein) En entier.
FR-A-862 867 (M. Compare) En entier.
FR-A-1 146 757 (A. Dodinet) Figures.

*Primary Examiner*—Forester W. Isen
*Attorney, Agent, or Firm*—Hayes, Soloway, Hennessey & Hage

[57] ABSTRACT

The invention relates to a wide passband omnidirectional loudspeaker which has particular application to high fidelity sound reproduction. The loudspeaker has a rigid, magnetostrictive, spherical diaphragm (3), a medium and high frequency electric control means connected to two terminals (4,5) located at two diametrically opposite points of the diaphragm for creating in the vicinity thereof a homogeneous magnetic field with respect to an electric signal applied to the terminals (4,5) of the control means after filtering (2) for eliminating the low frequencies, and a d.c. polarization means (11,12) for the diaphragm. The loudspeaker also has another low frequency electric control means (14) receiving the electric signal after filtering for eliminating the medium and high frequencies. This low frequency electric control means extends longitudinally along an axis (X'X) of the diaphragm and has two ends (16,17) respectively joined to two opposite zones of the diaphragm (3) traversed by axis (X'X).

13 Claims, 2 Drawing Sheets

Figure 4:
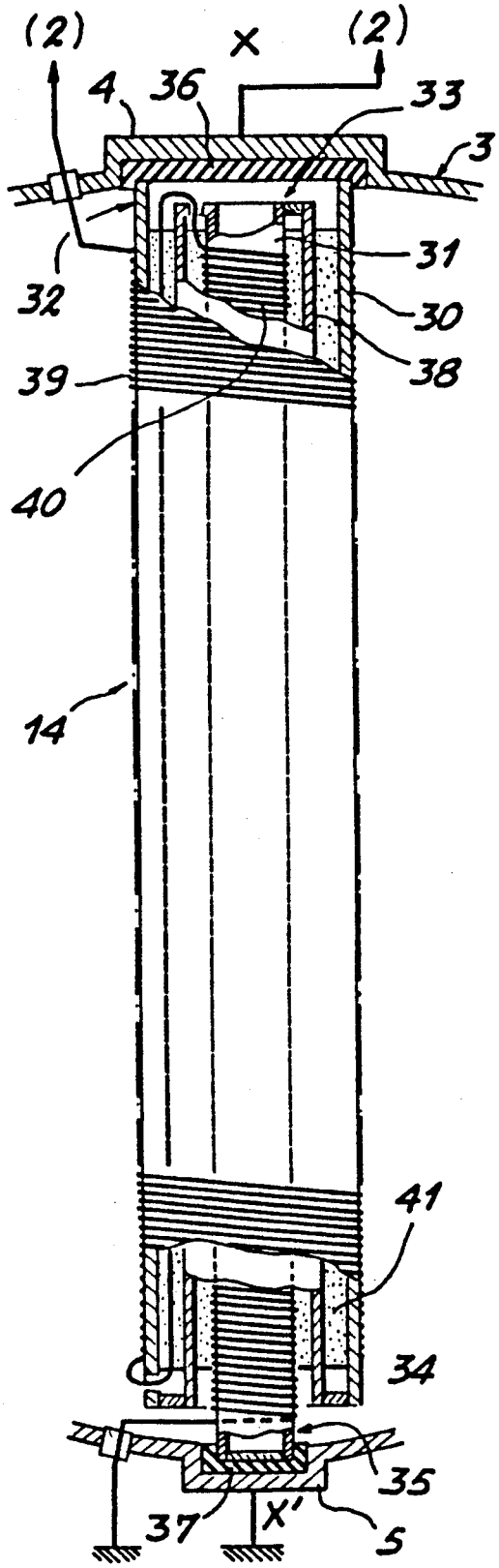

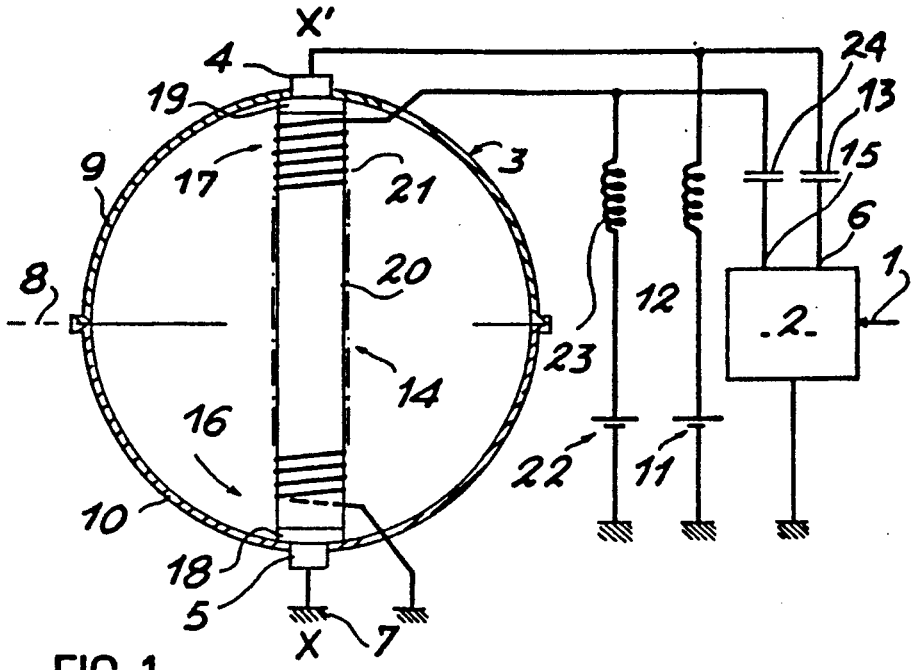
FIG. 1
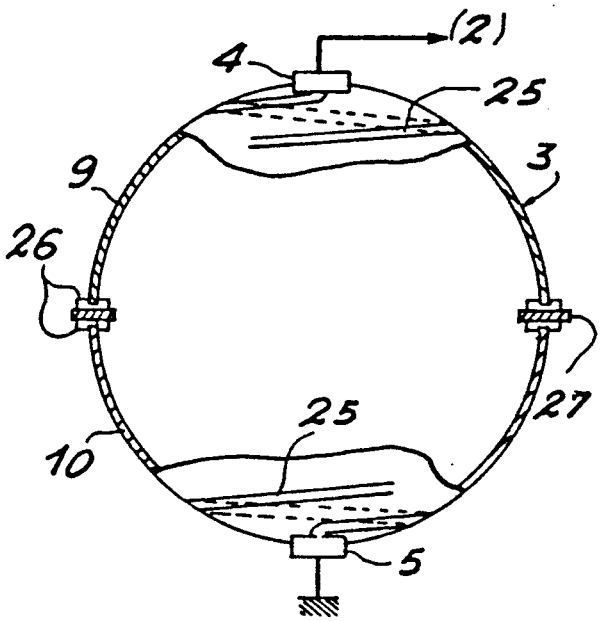
FIG. 2
FIG. 3
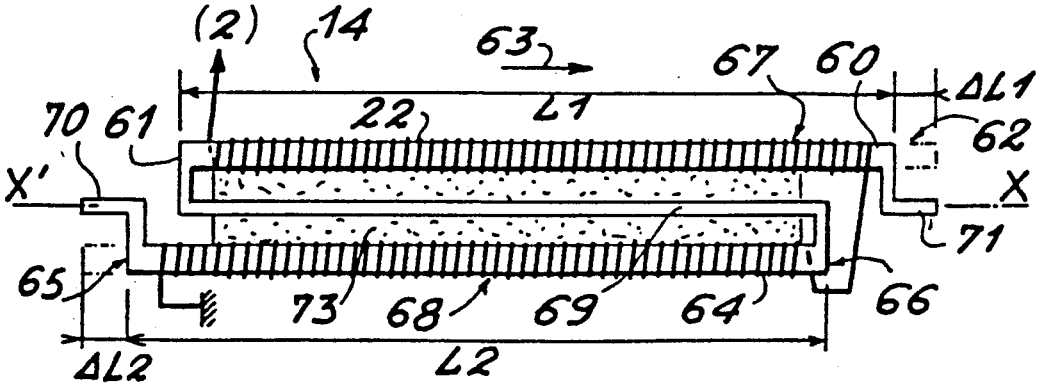

WIDE PASSBAND OMNIDIRECTIONAL LOUDSPEAKER

DESCRIPTION

The present invention relates to a wide passband omnidirectional loudspeaker able to supply deep, medium and sharp tones corresponding to low, medium or high frequencies of an electrical signal. This invention is applicable to the production of sounds in the acoustic high fidelity field.

European Pat. application No. 177 383 discloses a wide passband elastic wave omnidirectional transducer and more particularly an omnidirectional loudspeaker able to supply sounds or tones corresponding to different frequencies of an electrical signal. This loudspeaker comprises a thin, rigid magnetostrictive spherical diaphragm. Each zone of said diaphragm constitutes a sound wave unidirectional transducer in the normal direction thereof. It has a control means connected to two terminals located at two diametrically opposite points of the diaphragm, so as to create in the vicinity thereof a homogeneous magnetic field with respect to an electric signal applied to these two terminals. In order to reproduce the frequencies of the input electric signal, said omnidirectional loudspeaker is provided in known manner with a d.c. magnetic polarization means for the magnetostrictive diaphragm, which induces in the latter a constant magnetic field superimposed on the homogeneous field produced by the a.c. signal applied to the two terminals.

The principle of the loudspeaker described in the aforementioned application is based on the magnetostriction effect. Magnetostriction is the property of certain bodies or materials to undergo a geometrical modification (contraction, expansion, bending, twisting, etc.) when exposed to the influence of a magnetic field. Metal alloys and in particular ferromagnetic compounds are magnetostrictive materials.

The loudspeaker described in the aforementioned patent application functions in a range of medium and high frequencies corresponding to the medium and sharp tones to be reproduced. This loudspeaker has the main disadvantage of not being able to produce deep tones corresponding to low frequencies (e.g. below 500 Hz) of an electric signal applied thereto. Thus, for low frequencies, the amplitudes of the vibrations of the diaphragm are inadequate for producing deep tones. It is therefore necessary wIth such a loudspeaker to only apply to the terminals opposite to the magnetostrictive diaphragm control means an electric signal of medium and high frequency corresponding to the medium and sharp tones, whilst a low frequency electric signal corresponding to the deep tones is applied to a conventional loudspeaker or boomer, which has large dimensions, because in order that it can operate it must be enclosed in a large and very expensive acoustic enclosure.

The object of the present invention is to obviate this disadvantage and in particular to provide a wide passband omnidirectional loudspeaker able to supply deep, medium and sharp tones corresponding to the low, medium or high frequencies of an input electric signal, whereby said loudspeaker has a rigid, magnetostrictive, spherical diaphragm, without it being necessary to add to the exterior of said diaphragm, conventional electrodynamic loudspeakers enclosed in large and costly enclosures.

These objectives are achieved as a result of electric control means operating at low frequencies and extending longitudinally along an axis of the diaphragm and which have ends respectively integral with two opposite areas of said diaphragm, positioned in the vicinity of said axis.

The invention relates to a wide passband omnidirectional loudspeaker able to supply deep, medium and sharp tones, corresponding to low, medium or high frequencies of an electric signal, which has a rigid, magnetostrictive, spherical diaphragm, each diaphragm element constituting a sound wave unidirectional transducer in its normal direction, a medium and high frequency electric control means connected to terminals located at two diametrically opposite points of the diaphragm so as to create, in the vicinity thereof, a homogeneous magnetic field with respect to the electric signal applied to the terminals of the control means following filtering, eliminating the low frequencies, and a d.c. polarization means of the diaphragm, characterized in that it also has another low frequency electric control means receiving said electric signal after filtering eliminating the medium and high frequencies, said low frequency electric control means extending longitudinally along an axis of the diaphragm and having two ends respectively integral with two opposite zones of said diaphragm traversed by said axis.

According to another feature of the invention, said axis passes through the two terminals.

According to a first embodiment of the invention, the low frequency electric control means has at least one magnetostrictive bar with two ends, a coil for applying to said bar a homogeneous magnetic field relative to the low frequency electric signal applied to said coil, and at least one d.c. polarization means for the coil, the two ends of the bar being respectively joined to said opposite zones.

According to a feature of this first embodiment, the two ends of the bar are separated by a distance close to and less than the diameter of the spherical membrane, the bar and its coil being located within the diaphragm, intermediate parts respectively joining the ends of the bar and said opposite zones.

According to another feature of said first embodiment, the two ends of the bar are separated by a distance exceeding the diameter of the spherical diaphragm, the bar and its coil traversing said diaphragm in the vicinity of said axis, intermediate parts respectively joining together the ends of the bar and said zones. According to another embodiment of the invention, the low frequency electric control means has at least one first and one second coaxial, magnetostrictive, tubular bars, each bar having two ends separating by a distance close to, but less than the diameter of the spherical diaphragm, a first end of the first bar being close to a first end of the second bar and a second end of the first bar being close to a second end of the second bar, the first end of the first bar being joined to a first of the zones of the diaphragm, the second end of the second bar being joined to a second of the zones of the diaphragm, a magnetostrictive mechanical coupling tube, coaxial to the first and second bars for joining the first end of the second bar to the second end of the first bar, a first and a second coils for respectively applying to the first and second bars a magnetic field relative to the low frequency electric signal applied to said coils and a d.c. polarization means for each coil.

AccordIng to another embodiment, the low frequency electric control means has two electrodynamic motors, comprising in each case a mobile coil in the gap of a permanent magnet, each coil being supplied by said low frequency electric current and being oriented along said axis, each magnet being rendered integral with an intermediate part joined to the diaphragm in a diametral plane perpendicular to said axis, the coils respectively facing the two said zones of the diaphragm and being respectively joined to the zones by intermediate parts.

The features and advantages of the invention can he better gathered from the following description relative to the drawings, wherein show:

FIG. 1 diagrammatically an embodiment of a loudspeaker according to the invention.

FIG. 2 diagrammatically a variant of the aforementioned embodiment.

FIG. 3 diagrammatically another embodiment of the invention.

FIG. 4 diagrammatically a variant of the embodiment of FIG. 3.

Figure 5:
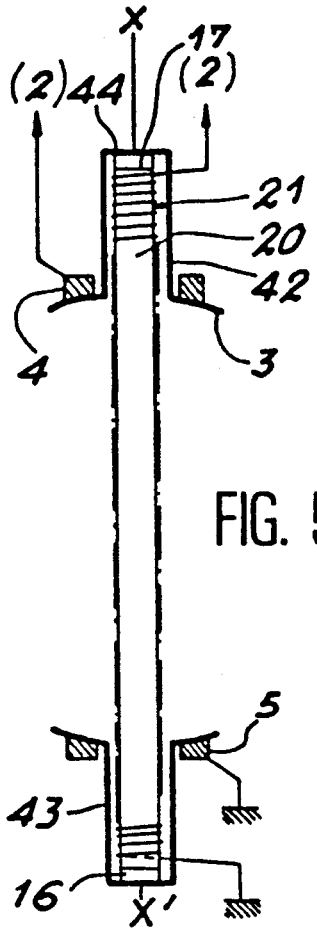

FIG. 5 a variant of the embodiment of FIG. 1.

Figure 6:
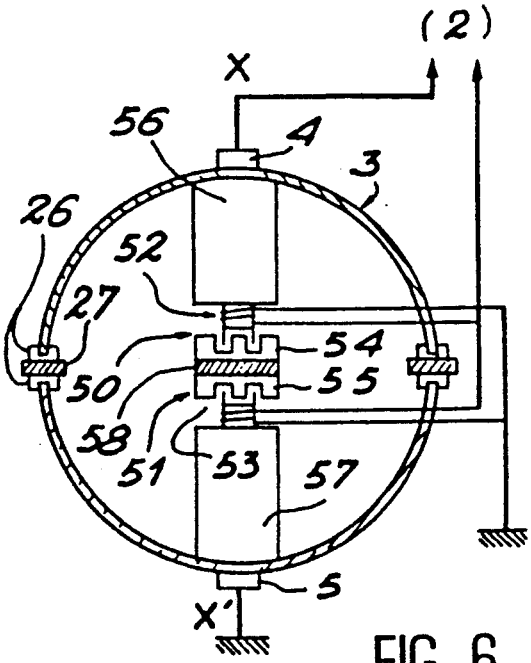

FIG. 6 another embodiment of the invention.

An embodiment of the wide passband omnidirectional loudspeaker according to the invention is diagrammatically shown in FIG. 1. This loudspeaker is able to supply deep, medium and sharp tones respectively corresponding to low, medium or high frequencies of an electric signal applied to the Input 1 of impedance matching and filtering means 2. The loudspeaker has a rigid, magnetostrictive, spherical diaphragm 3. In known manner, each zone of the diaphragm 3 constitutes a sound wave unidirectional transducer in the normal direction thereof. The loudspeaker also has a medium and high frequency electric control means connected to two terminals 4,5 located at two diametrically opposite points of the diaphragm in order to create, in the vicinity thereof, a homogeneous magnetic field with respect to the electric signal applied to the terminals. This electric signal is that supplied by an output 6 of the filtering and matching means 2, which apply to the terminal 4 the input signal 1, in which the low frequencies have been eliminated by a filter. The other terminal 5 of the control means is e.g. connected to reference earth or ground 7.

The medium and high frequency electric control means also has a d.c. polarization means for diaphragm 3. This d.c. polarization means can e.g. be constituted by a d.c. electric power supply 11, connected on the one hand to the reference earth 7 and on the other to the terminal 4 of the control means via an inductance 12 in series with power supply 11. This d.c. polarization serves to prevent, as explained in the aforementioned patent application, the doubling of the electric frequencies of the signal applied to the pulsating sphere. A decoupling capacitor 13 can also be provided between the output 6 of the matching and filtering means 2 and the terminal 4 of the medium and high frequency control means.

In this embodiment and according to a first variant, the terminals 4,5 of the control means are located at two diametrically opposite points of the diaphragm and are connected thereto for creating therein a homogeneous magnetic field corresponding to the medium and high frequency signal supplied by means 2. The diaphragm is in this case a hollow sphere of a magnetostrictive material, such as e.g. a nickel-cobalt alloy. This alloy is very easy to produce and very corrosion resistant. Sphere 3 is a homogeneous pulsating sphere. When a potential difference is applied between the terminals 4,5 connected to the sphere, all the points of the latter in known manner constitute identical elastic wave transmitters and consequently the sphere is a perfect omnidirectional elastic wave transmitter, as stated in the aforementioned patent application. The broken line 8 on the drawing is a diametral plan of the sphere which, for reasons of manufacturing ease, can be formed by two hemispheres 9,10 joined in the joining plane by a conductive adhesive or by a weld in exemplified manner.

According to the invention, the loudspeaker also has a low frequency electric control means 14, which receives the electric signal 1, after filtering for eliminating the medium and high frequencies. This low frequency signal can be supplied by an output 15 of the impedance matching and filtering means 2. The low frequency electric control means extends longitudinally along axis X'X of the diaphragm, which preferably passes through the terminals 4,5 of the medium and high frequency control means. The low frequency control means 14 has two ends 16,17 respectively joined, by means of Intermediate parts 18,19, to two opposite zones of the diaphragm traversed by axis X'X. These two zones are also two portions of the diaphragm positioned facing the terminals 4,5 of the medium and high frequency electric control means.

In the embodiment shown in the drawing, the low frequency electric control means 14 has at least one magnetostrictive bar 20 with the two ends 16,17 referred to hereinbefore and a coil 21 making it possible to apply to said bar a magnetic field relating to the low frequency electric signal supplied by the output 15 of the filtering and matching means 2. This low frequency electric signal is applied to one of the ends of the coil 21, whilst the other end of said coil is e.g. connected to the reference ground or earth 7.

As for the pulsating sphere, the low frequency electric control means also has a d.c. polarization means for coil 20. This d.c. polarization means can be formed by a d.c. electric power supply 22 associated with an inductance 23. It is also possible to provide a decoupling capacitor 24 between the output 15 of the matching and filtering means 2 and the coil 21. The d.c. power supply 22 makes it possible to induce in the magnetostrictive bar 20, a constant magnetic field, which is superimposed on the a.c. magnetic field produced by the low frequency signal.

Thus, the rigid sphere 3 is a pulsating sphere receiving the medium and high frequency electric signal for reproducing medium and sharp tones, whilst coil 21 makes it possible to reproduce the deep tones by varying the length of the bar having repercussions on sphere 3. As stated hereinbefore, this arrangement avoids the use of cumbersome, external loudspeakers for reproducing the deep tones. Thus, the elongated magnetostrictive bar makes it possible to obtain adequate vibration amplitudes and which act on the sphere to produce the deep tones. The two ends 16,17 of bar 20 are separated by a distance, which is close to and lower than the diameter of the spherical diaphragm. The bar and its coil are located within the diaphragm, so that the assembly has limited overall dimensions.

FIG. 2 shows a variant of the embodiment according to FIG. 1, as well as embodiments to be described hereinafter. FIG. 2 does not show the impedance matching and filtering means 2. The medium and high frequency electric control means have in this case, apart from the terminals 4,5 connected to the matching and filtering means 2 and the polarization means, a conductive tape 25, which is insulated from diaphragm 3 and connected to terminals 4,5. This conductive tape is wound onto the diaphragm in the manner of peeling an orange. It is traversed on the one hand by a d.c. magnetic polarization current of the magnetostrictive diaphragm and by the medium and high frequency modulating current for producing medium and sharp tones. The low frequency electric control means 14 are not shown, but it is obvious that these means are identical to those described hereinbefore, or to those described hereinafter. In this variant of the different embodiments of the invention, the pulsating diaphragm 3 has two hemispheres 9,10 joined by vibration damping parts 26 (speeders), which are integral with a ring 27. This arrangement described in the aforementioned patent application facilitates the manufacture and installation of the pulsating sphere.

FIG. 3 shows a variant of the embodiment of FIG. 1. According to this variant, the electrical control means 14 have a first linear magnetostrictive material bar 60 having a first end 61 and a second end 62, which are defined in a predetermined direction, e.g. in that of arrow 63. The first bar is associated with a first coil 67 able to induce a magnetic field in said first bar under the effect of a low frequency electric signal applied to said first coil and which is supplied by the matching and filtering means 2. This magnetic field leads to a length variation, e.g. an elongation $\Delta L1$ with respect to the bar length L1, if said signal supplied by the means 2 and the power supply 22 induces in the bar a variable magnetic field which is added to the d.c. polarization field of the bar.

Means 14 also have a second linear, magnetostrictive material bar 64 arranged parallel to and adjacent to the first bar 60. The second bar also has a first end 65 and a second end 66 designated in the direction of arrow 63. The second bar is associated with a second coil 68 able to induce a magnetic field in said second bar, under the effect of an electric current applied to the second coil. This electric current is supplied by impedance filtering and matching means 2 and by the d.c. power supply 22. It is assumed in this drawing that the two coils 67,68 are connected in series. When these coils are not connected in series, another output of the impedance matching and filtering means 2 and another d.c. power supply can be provided for supplying the second coil. The magnetic field induced in the second bar causes a length variation $\Delta L2$ to the bar length L2. If, as stated hereinbefore, the field induced in the second bar is a variable magnetic field, it is added to the d.c. polarization field of the second bar.

Finally, the low frequency control means 14 have mechanical coupling means between the first end 61 of the first bar and the second end 66 of the second bar. These mechanical coupling means can e.g. be constituted by a non-magnetostrictive rigid rod 69 (brass or copper or a rigid plastics material), joined to the first end 61 of the first bar and the second end 66 of the second bar. These coupling means make it possible to ensure the cumulation $\Delta L1+\Delta L2$ of the length variations of the first and second bars between ends 62 and 65 thereof. Thus, with low frequency control means of this type, whose longitudinal overall dimensions are less than the cumulated amount of the lengths $L1+L2$ of the two bars, it is possible to obtain length variations $\Delta L1+\Delta L2$ identical to the length variations which would be obtained if said two bars were placed end to end.

Preferably, the first and second bars 60,64, as well as the coils 67,68 respectively associated therewith and which form solenoids have identical masses. It is also preferable for the two bars to have identical lengths, in order to obtain identical length variations $\Delta L1$ and $\Delta L2$ It is obviously necessary for the windings of the coils associated with each bar to be calculated so as to Induce in the bars appropriate magnetic fields.

In order to ensure a perfect cumulation of the length variations of the bars, it is desirable when a magnetic field is induced in these bars for them to have equal movement quantities, when rod 69 is not integral with a fixed bar. It is precisely to obtain this result that the bars and their associated coils preferably have identical masses.

Intermediate parts 70,71, which are not magnetostrictive, make it possible to join the aforementioned low frequency control means to two opposite zones of the diaphragm, adjacent to axis X'X and terminals 4,5. It is also possible in the variant of this embodiment to incorporate, between the bars and the coupling rod 69, a flexible damping material 73, such as e.g. rubber, in order to prevent transverse vibrations during operation.

Finally, according to a variant of this embodiment not shown in the drawing, it is possible, in place of using two magnetic field induction coils, to use a single coil surrounding the two bars. This coil is obviously connected to the matching and filtering means 2, as well as to the d.c. power supply 22. In this case it is also possible to provide a flexible damping material 73. FIG. 4 shows a variant of the embodIment of the preceding drawings. According to this variant, the low frequency electric control means 14 have a first and a second tubular magnetostrictive bars 30,31, which are coaxial to one another and oriented along axis X'X. The drawing also shows the terminals 4,5 of the medium and high frequency electric control means electrically connected to sphere 3 and to the impedance matching and filtering means 2.

Each tubular bar has two ends separated by a distance close to, but less than the diameter of diaphragm 3. A first end 32 of the first bar 30 is adjacent to the first end 33 of the second bar 31, whilst a second end 34 of the first bar 30 is adjacent to a second end 35 of the second bar 31. The first end 32 of the first bar 30 is rendered integral, e.g. by means of an intermediate insulating part 36, with a first zone of the diaphragm, which is traversed by axis X'X and which is positioned facing the terminal 4 of the medium and low frequency electric control means. In the same way, the second end 35 of the second bar 31 is joined, by means of an insulating intermediate part 37, to a second zone of the diaphragm 3 traversed by axis X'X and which is positioned facing terminal 5 of the medium and low frequency electric control means.

In this embodiment, a non-magnetostrictive, mechanical coupling tube 38, located wIthIn the first bar and surrounding the second bar and coaxial to the first and second bars 30,31, makes it possible to join the first end 33 of the second bar to the second end 34 of the first bar. The low frequency electrical control means 14 also has a first and a second coils 39,40 making it possible to respectively apply to the first and second bars 30,31, a magnetic field relative to the low frequency electric signal applied to these terminals by the impedance matching and filtering means 2 described hereinbefore. Control means 14 also has a d.c polarization means, like the power supply 22 connected to inductance 23 and to capacitor 24 described hereinbefore and not shown in this drawing.

In this variant of the first embodiment of the loudspeaker according to the invention, it is desirable for the first bar 30 and the coil 39 associated therewith to have a mass close to that of the second bar 31 and the coil 40 associated therewith. Under these conditions, the movement quantities of the two bars are identical and the length variation of the first bar is added to the length variation of the second during the application of the low frequency electric signal to each of the coils. Under these conditions, when the magnetostrictive material forming each of the bars is a material undergoing an elongation when an a.c. field superimposed on the magnetic d.c. field is applied thereto, the first end 32 of the first bar and the second end 35 of the second bar move apart by a distance equal to the sum of the length variations of the two bars. Thus, with a low frequency electric control means, whose longitudinal size has a value L close to that of the diameter of the spherical diaphragm, it is possible to obtain a length variation having a value twice that obtained with the aid of a single bar, such as is shown in FIG. 1, whilst its size is close to that of L. Thus, with the aid of two tubular, coaxial bars of size L, it is possible to obtain length variations $2\Delta L$ identical to those which would be obtained if the two bars were placed end to end and having a size 2L.

In this embodiment, it is assumed that the coils 39,40 associated with the first and second bars are connected in series and supplied by the output signal 15 of the impedance matching and filtering means 2 and by the d.c. voltage of power supply 22. It would obviously be possible to supply these two coils separately by two d.c. power supplies and by two identical low frequency signals supplied by two different outputs of means 2, an impedance matching of each of the coils having been carried out in known manner, (e.g. a transformer for each coil) within the means 2.

As in the embodiment of FIG. 3, a flexible transverse vibration damping material 41 can be placed between each bar and the coupling tube 38.

FIG. 5 diagrammatically shows another variant of the embodiment of FIG. 1. According to this variant, the ends 16,17 of the magnetostrictive bar 20 surrounded by coil 21 are separated by a distance exceeding the diameter of the spherical diaphragm 3. The bar and its coil traverse the diaphragm in the vicinity of axis X'X. Intermediate parts make it possible to respectively join together ends 16,17 of bar 20 and the diaphragm zones traversed by axis X'X. These intermediate parts can e.g. have tubes 42,43 respectively joined to the ends of bar 20 and zones of the diaphragm adjacent to axis X'X and having openings traversed by the bar. These tubes can be joined to the diaphragm by welding for example. They can be joined to the bar 20 by means of covers, such as the cover 44 fixed to one end of tube 42 and joined, e.g. by means of an insulating adhesive to the end 17 of bar 20. In this embodiment, bar 20 has a longitudinal size greater than that of the diameter of diaphragm 3. As a result of its length, it makes it possible to produce pulsations of said diaphragm having adequate amplitudes at low frequencies to reproduce deep tones. Tubes 42,43 can advantageously be used for fixing the loudspeaker to a frame, which is not shown in this drawing, with the aid of flexible parts allowing vibrations of the bar. It is also possible to see terminals 4,5 of the medium and high frequency electric control means, which in this case are annular and are connected to the impedance matching and filtering means 2.

FIG. 6 shows another embodiment of the loudspeaker according to the invention. In this embodiment, the low frequency electric control means has two electrodynamic motors 50,51 comprising two coils 52,53, which are respectively mobile in the gaps of two permanent magnets 54,55. These mobile coils are supplied by the low frequency output signal of the impedance matching and filtering means 2 described hereinbefore. These coils and the permanent magnets associated therewith are oriented along axis X'X of the pulsating diaphragm 3, which can here be constituted by the two hemispheres shown in the variant of FIG. 2. These hemispheres are joined by ring 27 and by the damping parts or speeders 26. This drawing does not show the conductive tape connected to terminals 4,5 of the high and medium frequency electric control means. Each magnet is joined to the ring 27 by an intermediate part 58 located in the diametral plane perpendicular to axis X'X. Different elements making it possible to join together ring 27 and magnets 54,55 are not shown in this drawing. The coils 52 (three being respectively located facing the zones of the diaphragm traversed by axis X'X), which are themselves positioned facing terminals 4,5 of the medium and high frequency electric control means. Coils 52,53 are respectively joined to the zones by rigid intermediate parts 56,57, such as e.g. cylinders, which are fixed to these coIls and to the spherical cap 3. These parts have an adequate rigidity to pass to the diaphragm the low frequency pulsations from the movements of coils 52,53. These parts can e.g. be made from a plastics material or cardboard. In this embodiment, the loudspeaker has overall dimensions reduced to the external dimension of the spherical diaphragm.

In the embodiments of FIGS. 3 and 4, it is possible for the purpose of obtaining greater amplifications at low frequencies, to use imbricated arrangements identical to those described.

I claim:

1. Wide passband omnidirectional loudspeaker able to supply deep, medium and sharp tones, correspondingly to low, medium or high frequencies of an electric signal, said loudspeaker comprising a rigid magnetostrictive spherical diaphragm, the spherical diaphragm constituting a sound wave unidirectional transducer in the direction normal to the surface of the sphere, a medium and high frequency electric control means connected to terminals located at two diametrically opposite points of the diaphragm so as to create, in the vicinity of the diaphragm, a homogeneous magnetic field proportional to the electric signal, which electric signal is applied to the terminals of the control means after passing through filter which eliminates low frequencies, and a d.c. polarization means for the diaphragm, said loudspeaker further comprising a low frequency electric control means for receiving said electric signal after filtering eliminating the medium and high frequencies, said low frequency electric control means extending longitudinally along an axis (X'X) of the diaphragm and having two ends respectively integral with two opposite zones of said diaphragm traversed by said axis (X'X).

2. Loudspeaker according to claim 1 wherein the axis (X'X) passes through the said two terminals.

3. Loudspeaker according to claim 2, wherein the low frequency electric control means has at least one magnetostrictive bar with two ends, a coil for applying to said bar a homogeneous magnetic field associated with the low frequency electric signal applied to said coil, as well as at least one d.c. polarization means for the coil, the two ends of the bar respectively being joined to the said opposite zones.

4. Loudspeaker according to claim 3, wherein the bar ends are separated by a distance close to and less than the diameter of the spherical diaphragm, the bar and its coil being located within the diaphragm, there being intermediate parts which respectively join the bar ends and the opposite zones of the diaphragm.

5. Loudspeaker according to claim 3, wherein the two ends of the bar are separated by a distance exceeding the diameter of spherical diaphragm, the bar and its coil traversing said diaphragm in the vicinity of said axis (X'X), there being intermediate parts which respectively join together the bar ends and said opposite zones of the diaphragm.

6. Loudspeaker according to claim 2, wherein the low frequency electric control means has at least one first and one second coaxial, magnetostrictive, tubular bars, each bar having two ends separated by a distance close to, but less than the diameter of the spherical diaphragm, a first end of the first bar being close to a first end of the second bar and a second end of the first bar being close to a second end of the second bar, the first end of the first bar being joined to a first of the zones of the diaphragm, the second end of the second bar being joined to a second of the zones of the diaphragm, a magnetostrictive mechanical coupling tube coaxial to the first and second bars for joining the first end of the second bar to the second end of the first bar, and first and second coils for respectively applying to the first and second bars a magnetic field proportional to the low frequency electric signal applied to said coils, and a d.c. polarization means for each coil.

7. Loudspeaker according to claim 6, wherein the first and second bars are respectively surrounded by first and second coils for respectively applying to the first and second bars magnetic fields associated with the low frequency electric signal applied to these coils, the polarization means being connected to each coil.

8. Loudspeaker according to claim 7, wherein the first and second means are tubular and coaxial, the magnetic coupling means comprising a first tube located within a second tube, said second tube also constituting the first bar.

9. Loudspeaker according to claim 6 wherein a flexible, mechanical damping material is placed between the first bar and the coupling means and between the second bar and the coupling means.

10. Loudspeaker according to claim 2, wherein the low frequency electric control means has two electrodynamic motors comprising in each case a mobile coil in the gap of a permanent magnet, each coil being supplied by said low frequency electric current and being oriented along said axis (X'X), each magnet being rendered integral with an intermediate part joined to the diaphragm in a diametral plane perpendicular to said axis (X'X), the coils respectively facing the two said zones of the diaphragm and being respectively joined to the zones by intermediate parts.

11. Loudspeaker according to claim 7, wherein a flexible, mechanical damping material is placed between the first bar and the coupling means and between the second bar and the coupling means.

12. Loudspeaker according to claim 8, wherein a flexible, mechanical damping material is placed between the first bar and the coupling means and between the second bar and the coupling means.

13. Loudspeaker according to claim 1, and further comprising a conductive tape insulated from diaphragm and wound onto the diaphragm.

* * * * *

UNITED STATES PATENT AND TRADEMARK OFFICE

CERTIFICATE OF CORRECTION

PATENT NO. : 5,014,321

DATED : May 7, 1991

INVENTOR(S) : Siegfried Klein

It is certified that error appears in the above-identified patent and that said Letters Patent is hereby corrected as shown below:

Claim 8, col. 10, line 8, "means" should be "bars".

Signed and Sealed this

Nineteenth Day of January, 1993

*Attest:*

*Attesting Officer*

DOUGLAS B. COMER

*Acting Commissioner of Patents and Trademarks*